United States Patent [19]

Frech et al.

[11] 3,947,002

[45] Mar. 30, 1976

[54] METHOD OF BURNING-IN LINING IN BOTTOM BLOWN STEELMAKING FURNACE

[75] Inventors: Louis W. Frech, Chesterton, Ind.; David H. Hubble, Franklin Township, Westmoreland County, Pa.; Lewis J. Zook, Merrillville, Ind.

[73] Assignee: United States Steel Corporation, Pittsburgh, Pa.

[22] Filed: July 30, 1975

[21] Appl. No.: 600,232

[52] U.S. Cl. ..... 266/43; 266/35; 266/41

[51] Int. Cl.[2] ..... C21C 5/44

[58] Field of Search ..... 266/1 R, 35, 36 P, 41, 266/43; 110/182.5; 122/6.6

[56] References Cited

UNITED STATES PATENTS 3,610,183 10/1971 Kolboy et al. ..... 266/41 X 3,897,048 7/1975 Pearce et al. ..... 266/35

*Primary Examiner*—Gerald A. Dost

*Attorney, Agent, or Firm*—John F. Carney

[57] ABSTRACT

The burn-in of the refractory lining or of the refractory component of a tuyere-containing bottom plug in a bottom-blown oxygen steelmaking converter is effected with the plug in place by passing oxygen and a gaseous hydrocarbon mixed with controlled amounts of neutral gas through the respective concentric passages in tuyeres contained in the plug. The described method can be employed to burn-in a bottom plug installed in a converter together with a newly installed refractory converter lining or to burn in a newly installed bottom plug in an existing converter lining.

7 Claims, 3 Drawing Figures

METHOD OF BURNING-IN LINING IN BOTTOM BLOWN STEELMAKING FURNACE

BACKGROUND OF THE DISCLOSURE

Converter vessels in which molten metal is refined into steel are lined with refractory material in order to protect the vessel walls against the effects of the extremely high temperatures experienced during the refining process. The refractory material is conventionally comprised of a pitch-bearing basic aggregate such as periclase (MgO) or the like.

It is necessary in such practice, to preheat newly installed refractory material, commonly called "burn-in", in order to coke the carbon element in the pitch thus to prepare the refractory lining to resist slag and metal attack by closing the joints. The rate at which heat is applied must be controlled in order to prevent spalling of the refractory material or other adverse affects. Burn-in of the lining is also desirable in order to prevent severe thermal shock to the refractory which would result upon charging molten iron from a blast furnace to a converter having a cold, newly installed lining. Yet another reason for burning in a newly installed converter lining is to avoid severe and unpredictable temperature losses during the initial heats processed in the converter following relining caused by the excessive transfer of heat from the melt to the cold, newly installed material.

In a conventional top-blown oxygen converter, commonly referred to as a BOP converter, burn-in is readily accomplished by placing a carbonaceous material, such as wook or coke, in the converter bottom and burning this combustible material with a controlled rate of oxygen from the oxygen lance. By controlling the rate of oxygen flow through the lance, a definite rate of heating of the lining is accomplished.

In the bottom-blown steelmaking converter in which the process known as Q-BOP is practiced, one or more tuyeres are provided in the bottom of the vessel through which jacketed oxygen and other gases or particulate fluxes are blown upwardly into the melt to be refined. The tuyeres each comprise a pair of concentrically disposed pipes forming two concentrically spaced passages. The axial passage is adapted to pass oxygen and other refining materials while the annulus passes the jacketing gas which is a gaseous hydrocarbon, such as propane or natural gas.

The tuyeres in Q-BOP converters are normally mounted in a bottom plug within a monolithic or brick formed refractory matrix. Because the refractory employed as the matrix has a shorter operating life than that which lines the converter walls it is the practice to form the plug as a removable member such that the same can be readily replaced at intervals during the lifespan of the wall lining. Obviously, it is necessary to burn-in the refractory of each bottom plug prior to reinstating the converter to use.

Burn-in of the refractory material in a Q-BOP converter, both that which lines the converter walls and that which forms the matrix of the bottom plug, is a time-consuming and expensive proposition. Since no suspended oxygen lance is available, the procedure employed in BOP practice cannot be used. As an alternative therefore, it has been the practice to employ a special gas-oxygen burner which is suspended into the interior of the converter through the mouth thereof. While this method of burning-in the refractory has proved satisfactory from the standpoint of the affect produced in the material, it cannot be accomplished with the tuyeres completely in place due to the possibility of pitch or foreign particulate matter entering the tuyere passages to plug the same or the complex arrangement of tubes that are operatively connected to the tuyeres. Accordingly, procedures heretofore employed with Q-BOP converters have required that only the outer pipe be installed in the refractory bottom plug when burn-in is conducted. Following burn-in this pipe is cleaned and the inner pipe thereafter installed before operation of the converter is reinstated. While such a procedure may not be overly arduous when practiced on small converters, it is extremely difficult and time consuming to perform on large bottom-blown converters due to the difficulty encountered in making the installation completely leak-proof. Typically the time required to burn-in refractories by this method has been 10 to 20 hours when a new bottom plug is installed together with a new wall lining and 10 to 16 hours when the plug is installed in an existing lining.

It is to the improvement of such procedures therefore that the present invention is directed.

SUMMARY OF THE INVENTION

According to the present invention there is provided a method of burning-in refractory material in a bottom-blown oxygen steelmaking converter including tuyere means installed in the bottom of said converter, said tuyere means defining at least one passage for passing oxygen to the interior of said converter and another passage for passing a gaseous hydrocarbon thereto, comprising the steps of passing oxygen and gaseous hydrocarbon for combustion within the interior of said converter through each of said passages respectively regulating the flow of said oxygen and gaseous hydrocarbon to control the rate of heating said refractory and simultaneously passing a neutral gas in mixed relation with both of said oxygen and gaseous hydrocarbon in amounts to create a total fluid flow through said tuyere passages of sufficient magnitude to prevent the retrograde entry of foreign material thereinto.

It is therefore a principle object of the present invention to provide a method of burning-in the refractory material of a bottom-blown oxygen steelmaking converter in a shorter period of time than by methods heretofore known in the art.

For a better understanding of the invention, its operating advantages and the specific objectives obtained by its use, reference should be made to the accompanying drawings and description which relate to a preferred embodiment thereof.

DESCRIPTION OF PREFERRED EMBODIMENT OF THE INVENTION

Figure 1:
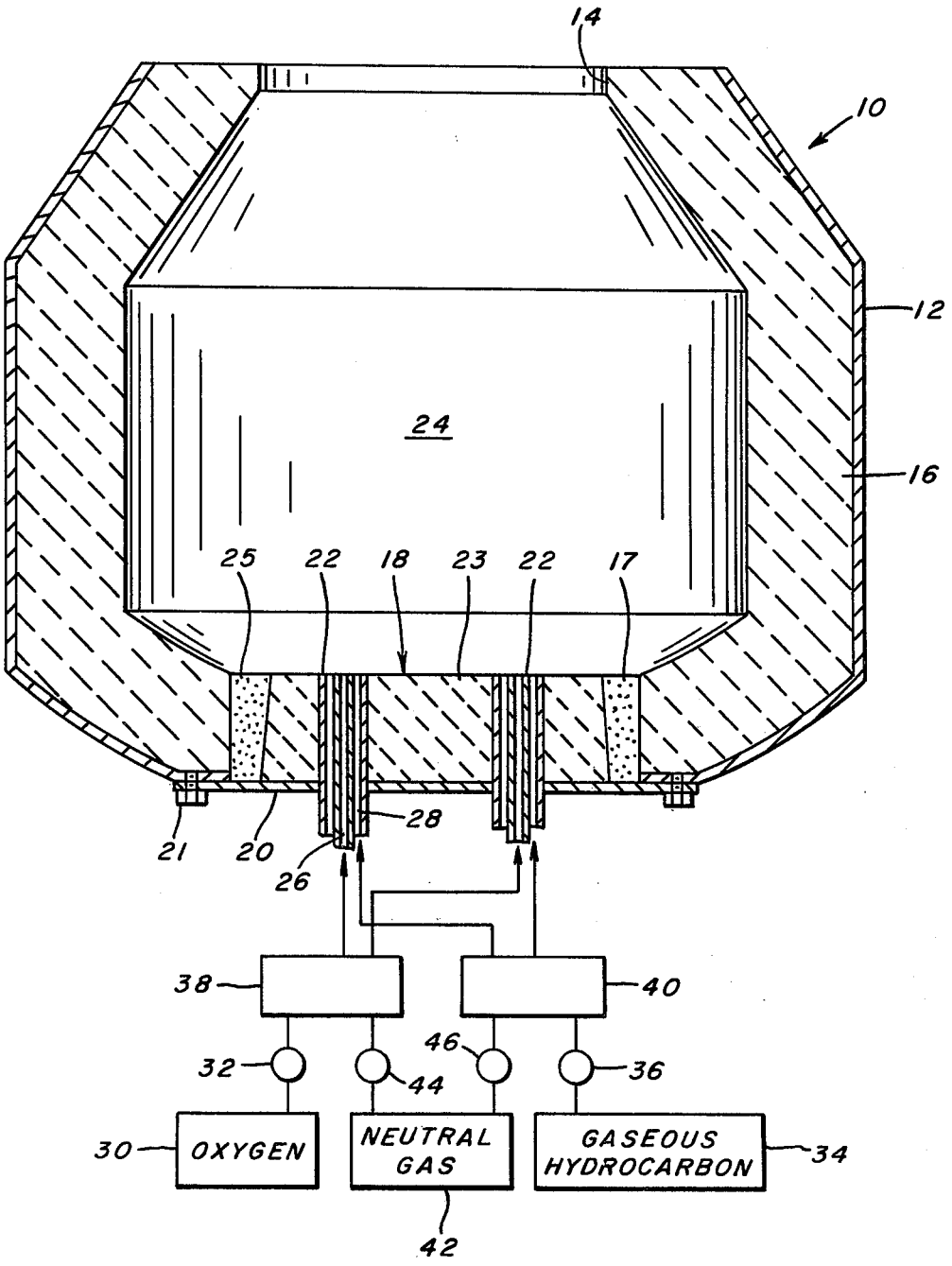
FIG. 1 is a partially schematic representation of a bottom-blown oxygen steelmaking converter vessel adapted to employ the refractory burn-in method of the present invention.

In FIG. 1 there is shown a bottom-blown oxygen steel-making converter 10 comprising a metal sheel 12 having a mouth opening 14 provided at the upper end thereof. The walls of the shell are lined with a refractory material 16 which is generally constructed of bricks formed of a pitch-bearing aggregate of periclase (MgO) or the like. The shell 12 and refractory lining 16 at the bottom of the converter 10 contains a through opening 17 that is filled by a removable plug, indicated generally as 18. The plug 18 comprises a metal bottom plate 20 that is attached to the shell 12 by fasteners 21. Tuyeres 22 are fixed to the plate and extend therethrough being operative to pass refining materials to a body of molten metal (not shown) that occupies the interior 24 of the converter when the same is in operation. The tuyeres 22 are surrounded by a matrix of material 23 that may be formed of a monolithic refractory or by an assembly of refractory bricks. The plug 18 is constructed with an outside diameter that is considerably smaller than the diameter of the opening 17 so as to define an annular clearance space 25 that is sealed by an appropriate refractory joint mixture.

As is characteristic of converters of the type capable of refining metal by the Q-BOP process, the tuyeres 22 are each formed by a pair of concentric tubular pipes defining an axial passage 26 and an annular passage 28 thereabout. In the practice of the process oxygen from a source 30 is passed in amounts regulated by valve 32 through the axial passage 26 to refine the metal to the desired characteristics. Simultaneously therewith a gaseous hydrocarbon, such as propane or natural gas from a source 34 is passed through the annular passage 28 in amounts regulated by valve 36 and in jacketing relation to the flow of oxygen from passage 26 thereby to protect the exposed tip of the tuyere tubes against burnout as is well known in the art. Although the drawing herein illustrates only two such tuyeres 22 it will be appreciated that in actual practice a converter vessel of 200 Ton capacity may employ as many as 16 or more tuyeres. Thus the flow lines connecting the sources 30 and 32 to the respective passages 26 and 28 in each tuyere have interposed therein manifold headers, here shown as oxygen header 38 and gaseous hydrocarbon header 40. The particular apparatus employed and the method involved in refining steel by the Q-BOP process is more fully described in U.S. Pat. No. 3,774,894, issued Nov. 27, 1973 to H. Knuppel, et al.

As successive heats of metal are refined by the process the refractory lining 16 of the shell walls is caused to erode due to the affects of high temperature and aggitation of the contained molten metal. Also, the refractory matrix 23 and the pipes of the tuyeres 22 are burned back and similarly eroded by the action of the melt and the high temperature environment. Because the refractory material forming the matrix 23 is subject to more severe conditions of temperature and erosion as compared with the refractory forming the converter lining 16, the plug 18 will be replaced several times during the life of the lining.

When a new bottom plug 18 is installed, either alone or together with a complete relining of the converter vessel, the refractory material must undergo a burn-in procedure to preheat the material for the reasons stated hereinabove. According to the present invention, the required burn-in procedure is conducted in a manner that enables the same to be accomplished with the bottom plug 18 completely assembled and attached in place to the converter vessel. More particularly, the present procedure permits the combustible fluids by which the preheating is accomplished to be supplied to the vessel interior through the fluid conducting passages 26 and 28 of the respective tuyeres 22 thereby eliminating the need for ancillary fuel burner apparatus for this purpose.

Thus, in the practice of this invention a source 42 of nitrogen, or other neutral gases such as argon is operatively connected to the respective tuyere manifold headers 38 and 40. Valves 44 and 46 are positioned in the nitrogen supply lines to regulate the gas flow to the respective headers.

The method of burning-in refractory newly installed in a converter vessel for the practice of the Q-BOP process according to the present invention involves in essence, regulating the flow of oxygen and gaseous hydrocarbon from sources 30 and 34 that are supplied to the tuyere passages 26 and 28 respectively to effect combustion in the vessel and accordingly control the heating rate of the refractory material. Simultaneously therewith, neutral gas from source 42 is flowed to the respective manifolds in regulated amounts to provide total gas flows through the tuyere passages 26 and 28 of a magnitude that prevents the entry of any foreign materials, such as loose refractories or flowing pitch or pitch vapors, into the passages. The flow of oxygen and gaseous hydrocarbon are regulated by valves 32 and 36 to gradually increase the rate of heating of the refractory material. In practice, the fluids are regulated to produce heating rates of 50° to 200°F per minute to maximums of 1800° to 2700°F followed by a holding period at these maximum temperatures of ½ to 2 hours. The amount of neutral gas supplied to the respective headers 38 and 40 from source 42 is such as to provide a total flow of fluid through the passages 26 and 28 to produce fluid pressures therein of between 15 and 30 psig.

Figure 2:
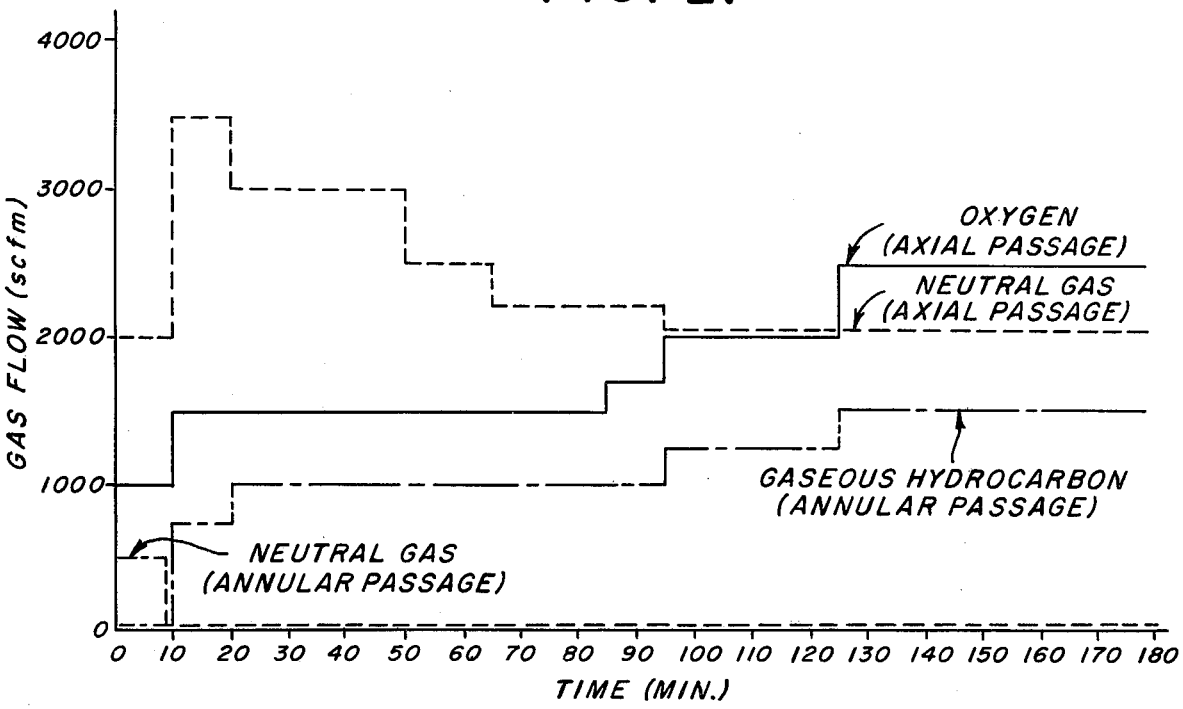
FIGS. 2 and 3 are graphic representations of the rates at which fluids are passed through the respective tuyeres in the converter vessel of FIG. 1 in the practice of alternate forms of the inventive method.

The following table, shown graphically in FIG. 2, illustrates typical flow rates for the respective fluids during the burn-in of a newly installed lining 16 and bottom plug 18 in a converter vessel of 200 ton capacity having twelve tuyeres 22 each provided with an axial passage 26 of 1.5 inches and an annular passage 28 of 0.047 inch width.

Table 1

| Time | Axial Passage (scfm) | | Annular Passage (scfm) | |
|---|---|---|---|---|
| (min.) | Oxygen | Neutral Gas | Hydrocarbon | Neutral Gas |
| 0–10 | 1000 | 2000 | 0 | 500 |
| 10–20 | 1500 | 3500 | 750 | 0 |
| 20–35 | 1500 | 3000 | 1000 | 0 |
| 35–50 | 1500 | 3000 | 1000 | 0 |
| 50–65 | 1500 | 2500 | 1000 | 0 |
| 65–95 | 1700 | 2200 | 1000 | 0 |
| 95–125 | 2000 | 2000 | 1250 | 0 |
| 125–155 | 2500 | 2000 | 1500 | 0 |
| 155–180 | 2500 | 2000 | 1500 | 0 |

Figure 3:
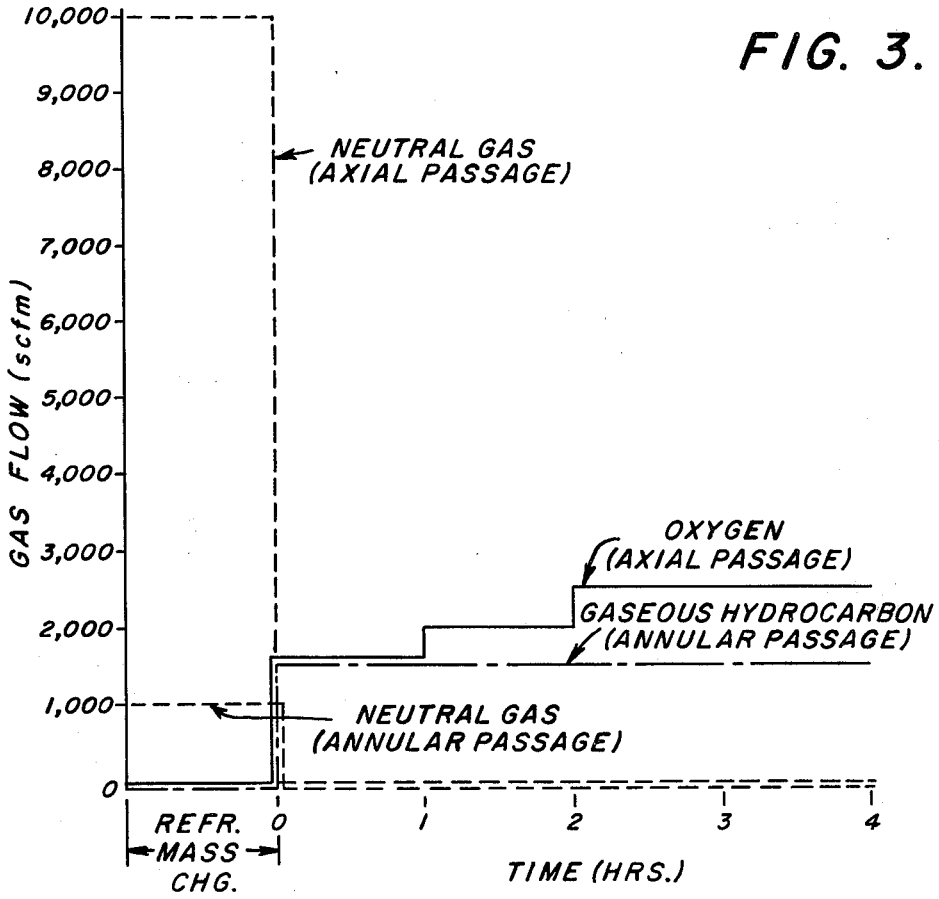

In instances in which a bottom plug 18 is replaced but the vessel wall lining 16 is not, the bottom plate 20 is attached to the shell 12 and refractory joint material is discharged through the vessel mouth 14. Thereafter the vessel is rocked on its trunnions (not shown) until the joint material has uniformly filled the clearance space 28. During this procedure the inventive method of burning in the refractory material is conducted by flowing fluids through the tuyeres 22 as shown in Table 2 and illustrated graphically in FIG. 3.

Table 2

| Time (hrs.) | Axial Passage (scfm) | | Annular Passage (scfm) | |
|---|---|---|---|---|
| | Oxygen | Neutral Gas | Hydrocarbon | Neutral Gas |
| joint material charge | 0 | 10000 | 0 | 1000 |
| 0 – 1 | 1600 | 4000 | 1500 | 0 |
| 1 – 2 | 2000 | 3000 | 1500 | 0 |
| 2 – 3 | 2500 | 3000 | 1500 | 0 |
| 3 – 4 | 2500 | 3000 | 1500 | 0 |

What is claimed is:

1. A method of burning-in refractory material in a bottom-blown oxygen steelmaking converter including tuyere means installed in the bottom of said converter, said tuyere means defining at least one passage for passing oxygen to the interior of said converter and another passage for passing a gaseous hydrocarbon thereto, comprising the steps of:

a. passing oxygen and gaseous hydrocarbon for combustion within the interior of said converter through each of said passages respectively;

b. regulating the flow of said oxygen and gaseous hydrocarbon to control the rate of heating said refractory; and c. simultaneously passing a neutral gas in mixed relation with at least one of said oxygen and gaseous hydrocarbon in amounts to create a total fluid flow through said tuyere passages of sufficient magnitude to prevent the retrograde entry of foreign material thereinto.

2. The method as recited in claim 1 including the step of controlling the flow of nitrogen to said one passage to provide a substantially constant total fluid flow rate therethrough.

3. The method as recited in claim 2 in which the ratio of oxygen to natural gas passed through said passages is increased to increase the intensity of the heat to which said refractory material is subjected

4. The method as recited in claim 3 in which said ratio of oxygen to natural gas is gradually increased over an extended period of time to raise the temperature to which said refractory materials are subjected to a maximum of about 2700°F.

5. The method as recited in claim 4 in which said refractory material is subjected to heat for a period of up to about five hours.

6. The method as recited in claim 3 including the step of increasing the flow of natural gas to said another passage in proportion to the increase of flow of oxygen to said at least one passage.

7. The method as recited in claim 2 in which said nitrogen is controlled to provide flow rates sufficient to establish fluid pressures in said passages of about 15 to 30 psig.

* * * * *